US011092335B2

(12) United States Patent
Thurlkill et al.

(10) Patent No.: US 11,092,335 B2
(45) Date of Patent: Aug. 17, 2021

(54) IGNITION CONTROL SYSTEMS FOR FUEL-FIRED DEVICES

(71) Applicant: Rheem Manufacturing Company, Atlanta, GA (US)

(72) Inventors: Stephen Thurlkill, Newbury Park, CA (US); Amin Akbarimonfared, Woodland Hills, CA (US); Jorge M. Gamboa, Oxnard, CA (US); Robert S. Glass, Tuscaloosa, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 187 days.

(21) Appl. No.: 15/878,001

(22) Filed: Jan. 23, 2018

(65) Prior Publication Data

US 2019/0226676 A1 Jul. 25, 2019

(51) Int. Cl.
*F23N 1/02* (2006.01)
*F23N 5/14* (2006.01)
(Continued)

(52) U.S. Cl.
CPC ..... *F23N 1/022* (2013.01); *F23N 5/082* (2013.01); *F23N 5/143* (2013.01); *F23N 5/184* (2013.01);
(Continued)

(58) Field of Classification Search
CPC .. F23N 1/022; F23N 2025/04; F23N 2027/02; F23N 2041/04; F23N 5/082; F23N 5/143; F23N 5/184; F24H 9/2035
See application file for complete search history.

(56) References Cited

U.S. PATENT DOCUMENTS 3,326,314 A * 6/1967 Wolf ..... B62D 59/02 180/321
4,613,072 A * 9/1986 Kikuchi ..... B60H 1/2209 237/12.3 C
(Continued)

FOREIGN PATENT DOCUMENTS

DE 4308484 A1 * 9/1994 ..... F23N 1/022
DE 19537773 A1 * 4/1997 ..... F23N 1/027
(Continued)

OTHER PUBLICATIONS

XVers—Type H. Heating zBoiler—Models 0856-3006. Catalog No. 2000.63. Effective Oct. 15, 2017. Raypak—A Rheem Company. pp. 1-3.
(Continued)

*Primary Examiner* — Jorge A Pereiro
*Assistant Examiner* — Logan P Jones
(74) *Attorney, Agent, or Firm* — Troutman Pepper Hamilton Sanders LLP

(57) ABSTRACT

A fuel-fired device can include an air-moving device that mixes air and a fuel to generate a fuel-air mixture. The fuel-fired device can also include an air box that provides the air to the air-moving device, and a fuel valve that provides the fuel to the air-moving device, where the fuel valve includes a tracking port coupled to the air box, where the tracking port detects a pressure of the air box. The fuel-fired device can further provide a pressure-regulating device disposed between a pressurized component and the tracking port of the fuel valve. The flow regulating device can control, during an ignition phase of operation, an amount of the fuel provided by the fuel valve to the air-moving device.

16 Claims, 5 Drawing Sheets

(51) Int. Cl.

| | |
|---|---|
| ***F24H 9/20*** | (2006.01) |
| ***F23N 5/08*** | (2006.01) |
| ***F23N 5/18*** | (2006.01) |

(52) U.S. Cl.
CPC ..... *F24H 9/2035* (2013.01); *F23N 2225/04* (2020.01); *F23N 2227/02* (2020.01); *F23N 2241/04* (2020.01)

(56) References Cited

U.S. PATENT DOCUMENTS

| | | | | |
|---|---|---|---|---|
| 6,561,791 | B1 * | 5/2003 | Vrolijk | F23N 1/022 431/12 |
| 2001/0032452 | A1 * | 10/2001 | Kamen | F02G 1/044 60/39.6 |

FOREIGN PATENT DOCUMENTS

| | | | | |
|---|---|---|---|---|
| DE | 10050254 | C1 * | 10/2002 | F23D 14/02 |
| EP | 0225655 | A1 * | 6/1987 | F23N 1/02 |

OTHER PUBLICATIONS

Xvers—Condensing Fire Tube. Installation Versatility. Raypak—A Rheem Company. Effective Nov. 1, 2017. pp. 1-6.

* cited by examiner

IGNITION CONTROL SYSTEMS FOR FUEL-FIRED DEVICES

TECHNICAL FIELD

The present disclosure relates generally to fuel-fired devices, and more particularly to systems, methods, and devices for controlling the ignition of gas-fired devices.

BACKGROUND

Boilers are used to heat a fluid (e.g., water). Other devices can serve similar functions. Boilers typically have a burner that burns a fuel (e.g., natural gas, propane) mixed with air. When this occurs, the resulting heat is thermally transferred to the fluid.

SUMMARY

In general, in one aspect, the disclosure relates to a fuel-fired device. The fuel-fired device can include an air-moving device that mixes air and a fuel to generate a fuel-air mixture. The fuel-fired device can also include an air box that provides the air to the air-moving device, and a fuel valve that provides the fuel to the air-moving device, where the fuel valve includes a tracking port coupled to the air box, where the tracking port detects a pressure of the air box. The fuel-fired device can further include a pressure-regulating device disposed between a pressurized component and the tracking port of the fuel valve. The pressure regulating device can control, during an ignition phase of operation, an amount of the fuel provided by the fuel valve to the air-moving device.

In another aspect, the disclosure can generally relate to a method for controlling ignition of a fuel-fired device. The method can include receiving a first signal that an ignition phase of operation is beginning. The method can also include operating a pressure-regulating device to alter a flow of fuel from a fuel valve to an air-moving device during the ignition phase of operation. The method can further include determining that the ignition phase of operation is complete. The method can also include operating the pressure regulating device to return to normal the flow of the fuel from the fuel valve to the air-moving device during normal operations after the ignition phase of operation is complete.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1:
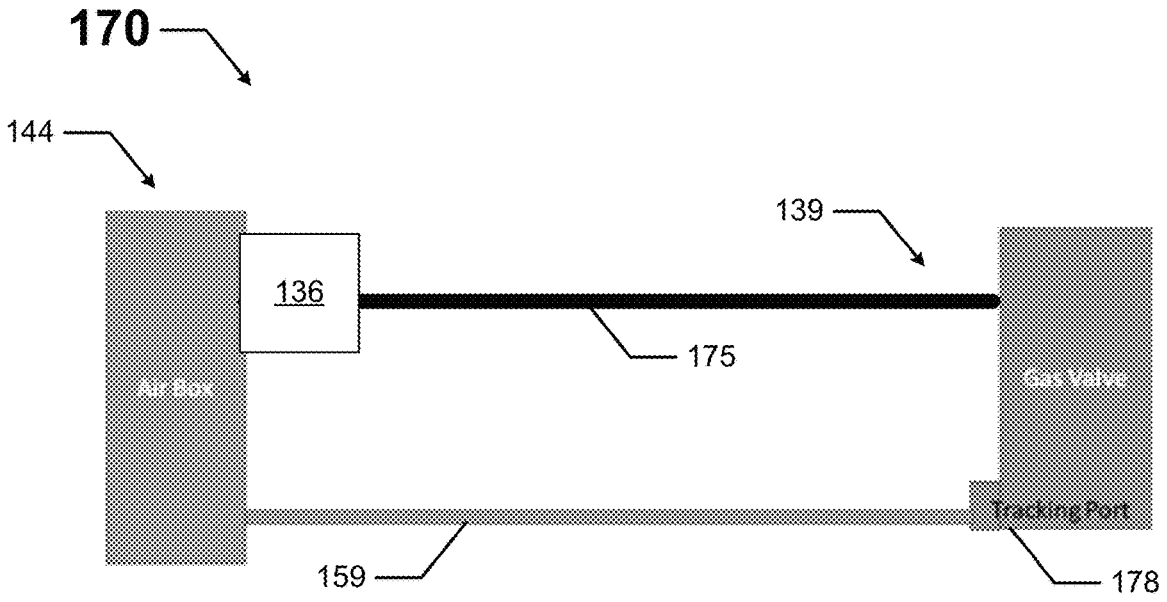
FIG. 1 (Prior Art)
FIG. 1 shows a subsystem of a fuel-fired device currently used in the art.

In general, example embodiments provide systems, methods, and devices for ignition control systems for fuel-fired devices. Examples of such fuel-fired devices can include, but are not limited to, boilers, pool heaters, gas furnaces, and water heaters. The fuel used by such devices can be any type of gas, including but not limited to natural gas, propane, and manufactured gases. These fuel-fired devices burn the fuel to generate heat for some process or purpose. In some cases, the fuel-fired devices having example embodiments discussed herein can be used in one or more of any type of environment, including but not limited to indoors, outdoors, hazardous, commercial, residential, industrial, high-humidity, dry, low temperature, high temperature, and corrosive.

The fuel-fired devices having example ignition control systems described herein can be made of one or more of a number of suitable materials to allow the fuel-fired devices and/or example ignition control systems to meet certain standards and/or regulations while also maintaining durability in light of the one or more conditions under which the fuel-fired devices and/or example ignition control systems can be exposed. Examples of such materials can include, but are not limited to, aluminum, stainless steel, fiberglass, glass, plastic, ceramic, and rubber.

Fuel-fired devices (or portions thereof) that include example ignition control systems described herein can be made from a single piece (as from a mold, injection mold, die cast, or extrusion process). In addition, or in the alternative, example fuel-fired devices (or portions thereof) that include example ignition control systems can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, fasten, abut against, and/or perform other functions aside from merely coupling.

A coupling feature (including a complementary coupling feature) as described herein can allow one or more components and/or portions of an example ignition control system (e.g., a solenoid valve) to become mechanically coupled, directly or indirectly, to a portion of a fuel-fired device (e.g., a tube that runs between an air moving device and a gas valve). A coupling feature can include, but is not limited to, an aperture, a recessed area, a protrusion, a slot, a spring clip, a male connector end, a female connector end, a tab, a detent, and mating threads. One portion of an example ignition control system can be coupled to a portion of fixture fuel-fired device by the direct use of one or more coupling features.

In addition, or in the alternative, a portion (e.g., a solenoid valve) of an example ignition control system can be coupled to a portion of a fuel-fired device using one or more independent devices that interact with one or more coupling features disposed on a component of the example ignition control system. Examples of such devices can include, but are not limited to, a sleeve, a pin, a collar, epoxy, welding, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

In the foregoing figures showing example embodiments of ignition control systems for fuel-fired devices, one or more of the components shown may be omitted, repeated, and/or substituted. Accordingly, example embodiments of ignition control systems for fuel-fired devices should not be considered limited to the specific arrangements of components shown in any of the figures. For example, features shown in one or more figures or described with respect to one embodiment can be applied to another embodiment associated with a different figure or description.

In certain example embodiments, ignition control systems for fuel-fired devices are subject to meeting certain standards and/or requirements. For example, the National Electric Code (NEC), the American National Standards Institute (ANSI), the Canadian Standards Association (CSA), the International Electrotechnical Commission (IEC), the American Society of Mechanical Engineers (ASME), the American Society of Heating, Refrigeration and Air Conditioning Engineers (ASHRAE), Underwriters' Laboratories (UL), the National Fire Protection Association (NFPA), and the Institute of Electrical and Electronics Engineers (IEEE) set standards for fuel-fired devices. Use of example embodiments described herein meet (and/or allow a corresponding device to meet) such standards when required.

As a specific example, the state of California has a number of environmental compliance districts. One of these districts, the South Coast Air Quality Management District (SCAQMD) requires that certain gas-fired devices, such as gas-fired device 502 of FIG. 5 below, that consume more than 2 MMBTU/hr can emit no more than 9 ppm of NOx at any point in time during their operation. Violation of this requirement within the SCAQMD can result in fines and/or other penalties.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits.

In addition, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of ignition control systems for fuel-fired devices will be described more fully hereinafter with reference to the accompanying drawings, in which example embodiments of ignition control systems for fuel-fired devices are shown. Ignition control systems for fuel-fired devices may, however, be embodied in many different forms and should not be construed as limited to the example embodiments set forth herein. Rather, these example embodiments are provided so that this disclosure will be thorough and complete, and will fully convey the scope of ignition control systems for fuel-fired devices to those of ordinary skill in the art. Like, but not necessarily the same, elements (also sometimes called components) in the various figures are denoted by like reference numerals for consistency.

Terms such as "first", "second", "top", "bottom", "side", "distal", "proximal", and "within" are used merely to distinguish one component (or part of a component or state of a component) from another. Such terms are not meant to denote a preference or a particular orientation, and are not meant to limit embodiments of ignition control systems for fuel-fired devices. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a subsystem 170 of a fuel-fired device currently used in the art. The subsystem 170 includes an air box 144, and air-moving device 136, and a gas valve 139 connected (coupled) to each other by a pressure communication component 159 (in this case, piping or tubing) and/or by a delivery component 175. Under this configuration, the pressure in the air box 144 is communicated to a tracking port 178 of the gas valve 139 through the pressure communication component 159.

The gas valve 139 is a device that regulates the flow of gas (a form of fuel) through a delivery component 175 to the air-moving device 136, where the gas and air are mixed and sent to a burner (e.g., burner 542 of FIG. 5 below). The gas valve 139 can include one or more of a number of components. Examples of such components can include, but are not limited to, a valve, a motor, a coil, one or more contacts, a tracking port, an inlet port, and outlet port, and a meter (a form of sensor device 560, as discussed in FIG. 5 below). The gas valve 139 can operate independently (e.g., manual settings, fixed settings) of other components of the gas-fired device (e.g., gas-fired device 502 in FIG. 5 below). In addition, or in the alternative, one or more components (e.g., the controller 504 in FIG. 5 below) of the gas-fired device 502 can operate the gas valve 139.

As discussed below, when the gas valve 139 includes a tracking port, the tracking port senses, through a pressure communication component (e.g., pressure communication component 159), an amount of pressure within the air box 144 or some other component (e.g., the air-moving device 136) of the gas-fired device 502. In such a case, and as will be discussed in relation to FIG. 2, the pressure-regulating device 279 can be disposed in the pressure communication component (e.g., pressure communication component 159). In this way, the pressure-regulating device 279 can operate to create a temporary artificial pressure sensed by the tracking port of the gas valve 139, causing the gas valve 139 to alter the amount of gas that the gas valve 139 delivers to the air-moving device 136.

The air-moving device 136 of the gas-fired device 102 receives air from the air box 144 and gas from the gas valve 139 so that the air and the gas can be mixed. This mixture is then sent by the air-moving device 136 to the burner 542. The air box 144 can merely be an enclosed volume of space. Alternatively, the air box 144 can include one or more of a number of features (e.g., baffles, ducts, channels) and/or components. The air-moving device 136 can generate and move air from the air box 144. The air can be ambient air, heated air, processed air, or any other type of air. Examples of an air-moving device 136 can include, but are not limited to, a fan and a blower. The air-moving device 136 can run at variable speeds or fixed speeds. In some cases, the air-moving device 136 can be a collection or network of individual air-moving devices. In this case, the air-moving device 136 is configured, at least in part, to take air from the air box 144 to mix with the fuel from the gas valve 139 for combustion in the burner 542.

The tracking port 178 of the gas valve 139 receives and (in some cases, using a sensing device 160) measures the pressure of the air box 144 at a given moment in time. The gas valve 139, realizing the pressure of the air box 144 as read at the tracking port 178 through the pressure communication component 159, can make adjustments as to the amount of fuel (in this case, a form of gas) delivered by the gas valve 139 to the air-moving device 136 through the delivery component 175. When the fuel from the gas valve 139 is delivered to the air-moving device 136, the fuel is mixed with air delivered from the air-box 144. The air/fuel mixture is sent by the air-moving device 136 to a burner (e.g., burner 542 in FIG. 5 below).

There is no pressure-regulating device (as described below) in this subsystem 170, and so the rate at which gas is delivered from the gas valve 139 to the air-moving device 136 is based on the actual pressure in the air box 144. As a result, in the current art, the ignition phase of operation may result in an insufficient flame during normal operations.

Figure 2:
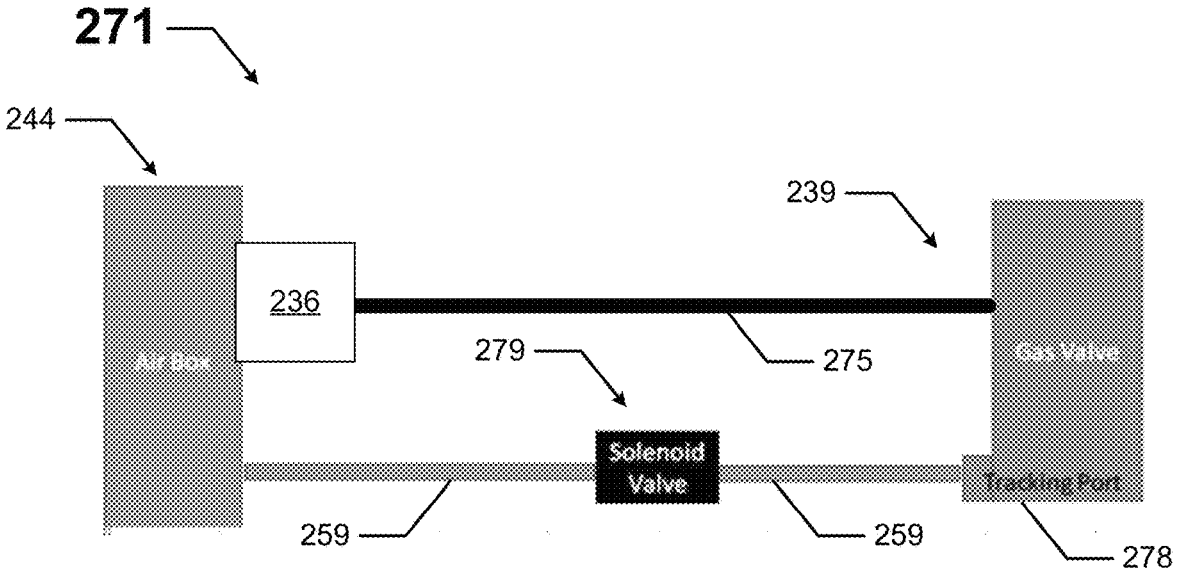
FIG. 2 shows a subsystem of a fuel-fired device in accordance with certain example embodiments.

FIG. 2 shows a subsystem 271 of a fuel-fired device in accordance with certain example embodiments. Referring to FIGS. 1 and 2, the subsystem 271 includes an air box 244, and air-moving device 236, and a gas valve 239 connected (coupled) to each other by a delivery component 275 (in this case, piping) and a pressure communication component 259. The subsystem 271 also includes a pressure regulating device 279 (in this case, a solenoid valve) connected (coupled) to the pressure communication component 259 between the air box 244 and the gas valve 239. The air box 244, the air-moving device 236, the gas valve 239, the pressure communication component 259, and the delivery component 275 are substantially the same as those described above with respect to FIG. 1.

The pressure-regulating device 279 can be any of a number of devices that control one or more pressures communicated through a pressure communication component (e.g., pressure communication component 259). A pressure-regulating device 279 can have two or more discrete positions (e.g., fully open, fully closed) or a number of varying positions (e.g., 25% open, 33% closed). A pressure-regulating device 279 can have one or more of any of a number forms, including but not limited to a solenoid valve (e.g., normally-open, normally-closed), a damper, a shutter, a louver, and a gate.

Regardless of its form, the pressure-regulating device 279 can operate based on a signal initiated from another portion (e.g., the controller 504, a sensor module 560) of the gas-fired device 502 (all as discussed below with respect to FIG. 5). Specifically, when an ignition phase of operation is about to begin, the pressure-regulating device 279 is called upon to regulate the pressure communicated from a device (e.g., the air box 244) to the gas valve 239, thereby altering the amount of gas sent by the gas valve 239 to the air-moving device 236 through a delivery component 275. Similarly, when the gas ignition phase of operation has ended, the pressure-regulating device 279 is called upon to stop altering the pressure communicated from the air box 244 to the gas valve 239.

Figure 3:
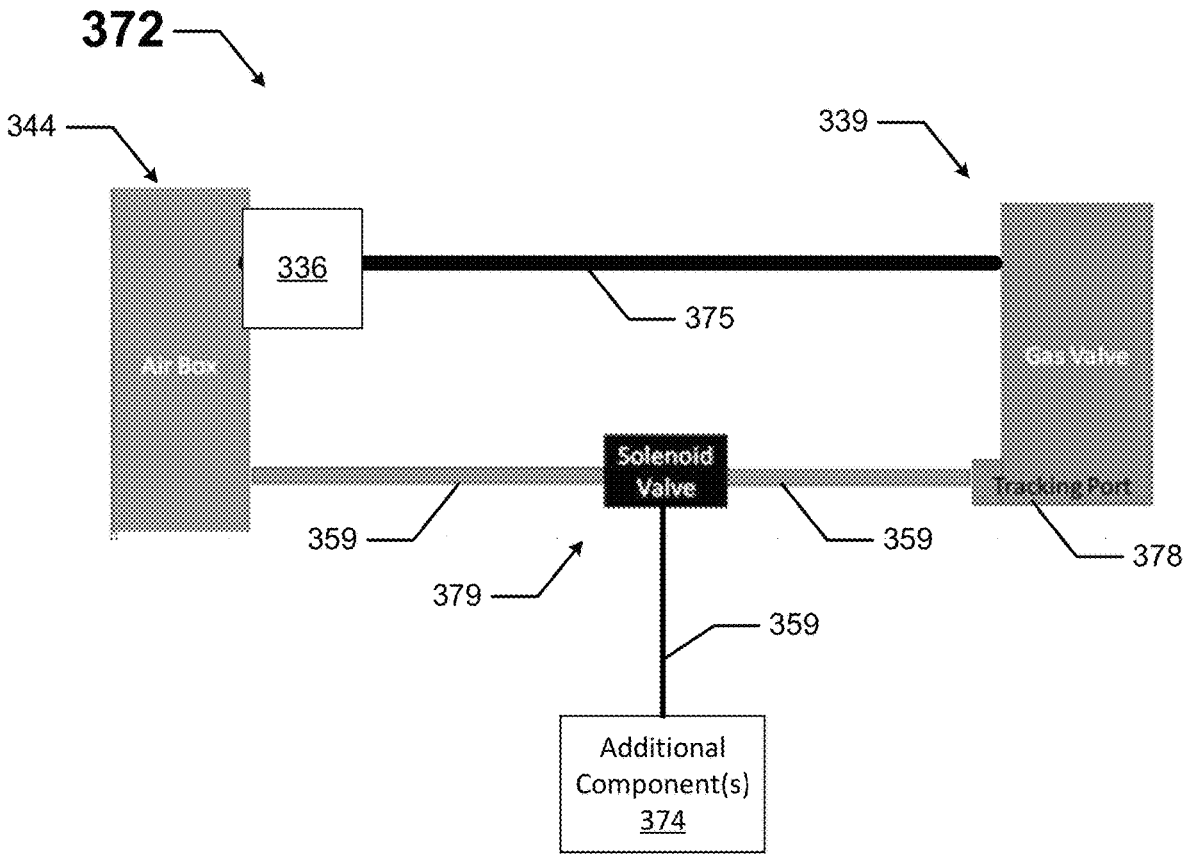
FIG. 3 shows another subsystem of a fuel-fired device in accordance with certain example embodiments.

As with the subsystem 372 of FIG. 3, under this configuration, the pressure in the air box 244 is communicated to a tracking port 278 of the gas valve 239 through the pressure communication component 259. Since the subsystem 271 of FIG. 2 includes the pressure regulating device 279, the rate at which gas is delivered from the gas valve 239 to the air-moving device 236 through the delivery component 275 can be momentarily altered by operating the pressure regulating device 279 during the ignition phase of operation, thereby resulting in an enriched flame.

FIG. 3 shows another subsystem 372 of a fuel-fired device in accordance with certain example embodiments. Referring to FIGS. 1-3, the subsystem 372 includes an air box 344, air-moving device 336, and a gas valve 339 connected (coupled) to each other by a delivery component 375 (in this case, piping) and/or a pressure communication component 359. The subsystem 371 also includes a pressure regulating device 379 (in this case, a 3-way solenoid valve) connected (coupled) to the pressure communication component 359 between the air box 344 and the gas valve 339, as well as one or more additional components 374 that is connected (coupled) to the pressure regulating device 379 by a separate pressure communication component 359 (also piping in this case).

The air box 344, the air-moving device 336, the gas valve 339, the pressure regulating device 379, the pressure communication component 359, and the delivery component 375 are substantially the same as those described above. The additional component 374 can be any device or process that provides an alternative indication of pressure. Examples of additional component 374 can include, but are not limited to, a vent valve and a pressure-creating device (e.g., air-moving device 336).

Depending on the position of the pressure regulating device 379, the pressure of the air box 344 or the pressure or absence of the additional component 374 (or some combination thereof) is communicated to a tracking port 378 of the gas valve 339 through the pressure communication component 359. Since the subsystem 372 of FIG. 3 includes the pressure regulating device 379, the rate at which gas is delivered from the gas valve 339 to the air-moving device 336 through the delivery component 375 can be momentarily altered by operating the pressure regulating device 379 during the ignition phase of operation, thereby resulting in an enriched flame.

Figure 4:
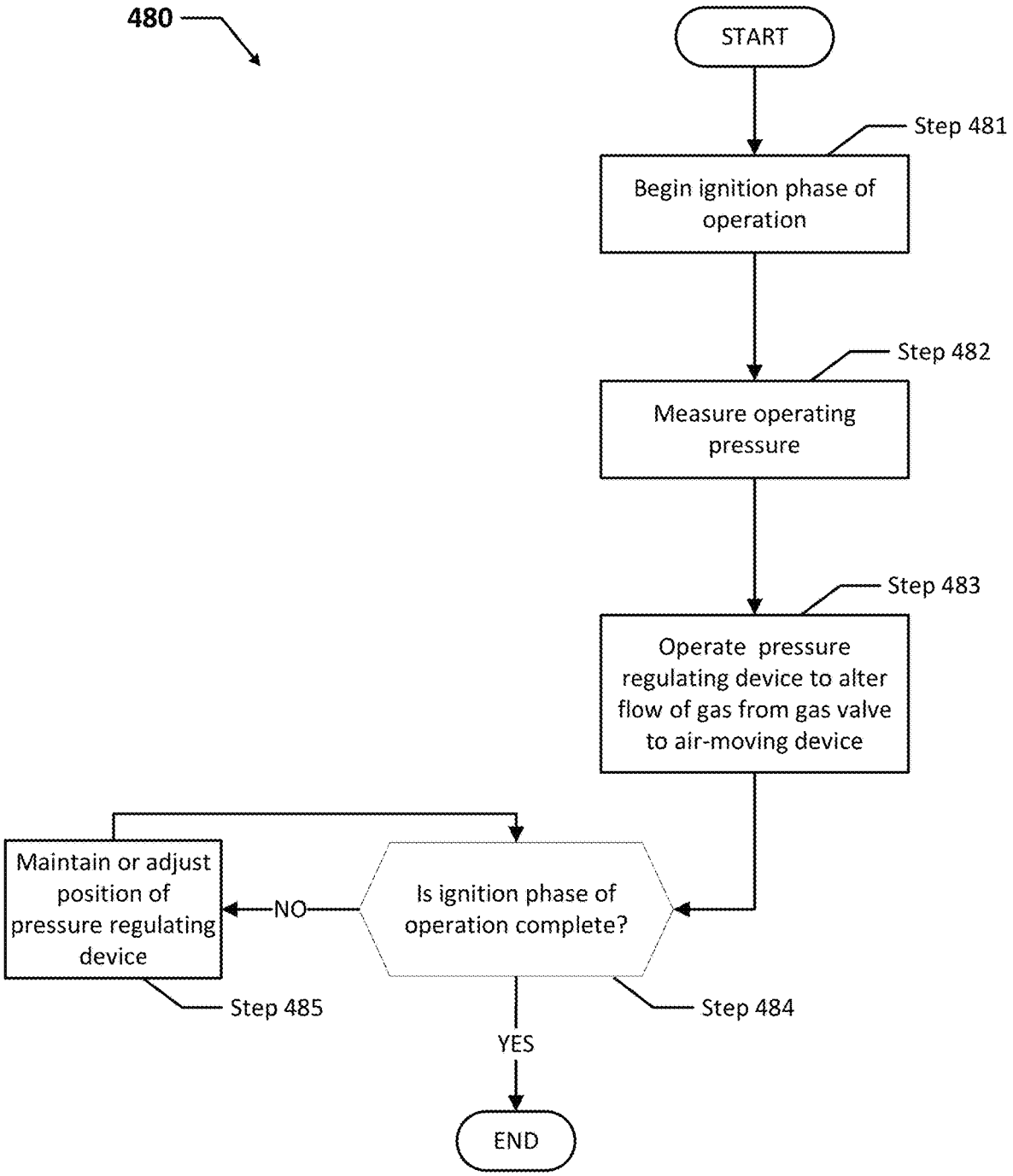
FIG. 4 shows a flowchart of a method for controlling a flow of air mixed with fuel for a gas-fired device in accordance with certain example embodiments.

FIG. 4 shows a flowchart of a method 480 for controlling a flow of air mixed with fuel for a gas-fired device in accordance with certain example embodiments. While the various steps in this flowchart are presented and described sequentially, one of ordinary skill in the art will appreciate that some or all of the steps can be executed in different orders, combined or omitted, and some or all of the steps can be executed in parallel depending upon the example embodiment. Further, in one or more of the example embodiments, one or more of the steps described below can be omitted, repeated, and/or performed in a different order. For example, the process of optimizing a water heating system can be a continuous process, and so the START and END steps shown in FIG. 6 can merely denote the start and end of a particular series of steps within a continuous process.

In addition, a person of ordinary skill in the art will appreciate that additional steps not shown in FIG. 4 can be included in performing these methods in certain example embodiments. Accordingly, the specific arrangement of steps should not be construed as limiting the scope. In addition, a particular computing device, as described, for example, in FIG. 6 below, can be used to perform one or more of the steps for the methods described below in certain example embodiments. For the methods described below, unless specifically stated otherwise, a description of the controller (e.g., controller 504 of FIG. 5 below) performing certain functions can be applied to the control engine (e.g., control engine 506) of the controller.

Referring to FIGS. 1-4, the example method 480 of FIG. 4 begins at the START step and proceeds to step 481, where an ignition phase of operation begins. The ignition phase of operation is with respect to a gas-fired device (e.g., gas-fired device 502). The ignition phase of operation refers to commencing operations of the gas-fired device. Starting the ignition phase of operation can be determined by a user 550, a sensor 560, the controller 504 (or component thereof), or some other factor or component of the system 500 (all defined below with respect to FIG. 5).

In step 482, an operating pressure is measured. The operating pressure can be measured by a sensor module 560 at the tracking port (e.g., tracking port 278) of the gas valve 239. The operating pressure can be communicated to the tracking port of the gas valve 239 by a pressure communication component (e.g., pressure communication component 259). The operating pressure is with respect to one or more components of the gas-fired device 502. Such components can include, but are not limited to, the air box 244, the air-moving device 236, and the gas valve 239.

In step 483, a pressure regulating device 279 is operated to alter the flow of gas from the gas valve 239 to the air-moving device 236. The pressure regulating device 279 can be operated by, as non-limiting examples, a user 550, a sensor 560, the gas valve 239, and the controller 504. When the pressure regulating device 279 operates, it can reduce, increase, or stop the flow of gas from the gas valve 239 to the air-moving device 236 through a delivery component 275. The pressure regulating device 279 can be connected (coupled) to a pressure communication component 259 (e.g., piping, tubing), which is used to communicate pressure from the air box 244 (or an additional component 374) to the tracking port (e.g., tracking port 278) of the gas valve 239.

In step 484, a determination is made as to whether the ignition phase of operation is complete. This determination can be made in one or more of any number of ways. For example, a passage of time (e.g., five seconds), as measured by the timer 510 (described below with respect to FIG. 5), can dictate that the ignition phase of operation is complete. As another example, a sensor device 560 (e.g., a flame detector), upon measuring a consistent flame in the burner 542, can dictate that the ignition phase of operation is complete. As yet another example, the control engine 506 of the controller 504, considering a number of different inputs, factors, protocols 532, and algorithms 533, can determine that the ignition phase of operation is complete. As still another example, a user 550 can dictate that the ignition phase of operation is complete. Regardless of how the determination is made, if the ignition phase of operation is complete, then the process proceeds to the END step. If the ignition phase of operation is not complete, then the process proceeds to step 485.

In step 485, the position of the pressure-regulating device 279 is maintained or adjusted. The position of the pressure regulating device 279 can be maintained of adjusted by, as non-limiting examples, a user 550, a sensor 560, the gas valve 239, and the controller 504. In some cases, the position of the pressure regulating device 279, rather than being maintained, can be further adjusted to some position that is different from the position of the pressure-regulating device 279 during normal operation of the gas-fired device 502. By maintaining the position of the pressure-regulating device 279, the gas valve 239 can continue to deliver an adjusted (e.g., higher) amount of gas to the air-moving device 236 through the delivery component 275. When step 485 is complete, the process reverts to step 484.

Figure 5:
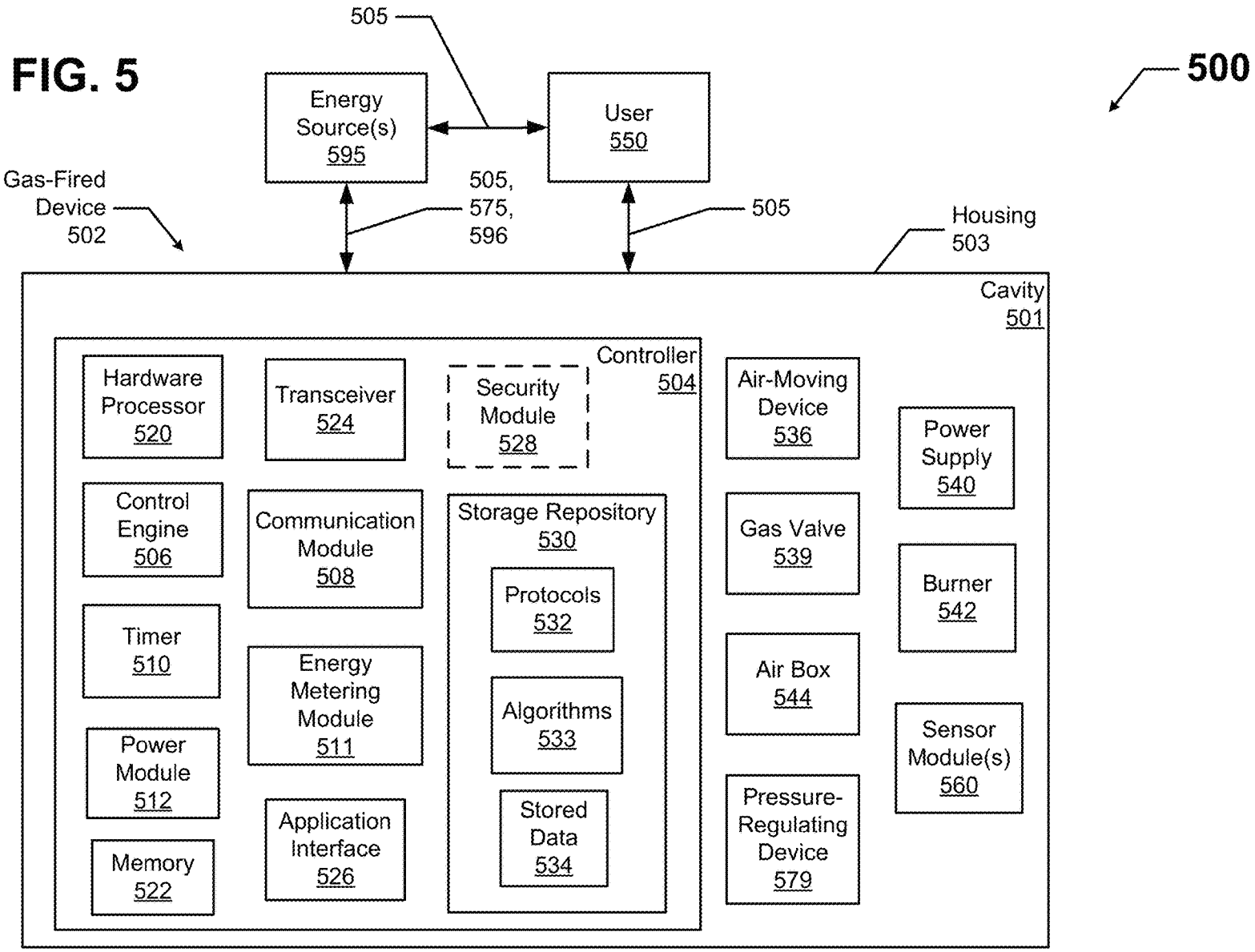
FIG. 5 shows a system diagram of a system that includes a fuel-fired device in accordance with certain example embodiments.

FIG. 5 shows a system diagram of a system 500 that includes a controller 504 of a gas-fired device 502 in accordance with certain example embodiments. The system 500 can include an energy source 595, a user 550, and at least one gas-fired device 502. In addition to the controller 504, the gas-fired device 502 can include at least one air-moving device 536, one or more gas valves 539, one or more pressure-regulating devices 579, an air box 544, one or more sensor modules 560 (also sometimes called a sensor 560 or a sensor device 560 herein), at least one power supply 540, and at least one burner 542. The air box 544, the gas valve 539, and the pressure communication component 559 are substantially the same as those described above with respect to FIGS. 1-4.

The controller 504 can include one or more of a number of components. As shown in FIG. 5, such components can include, but are not limited to, a control engine 506, a communication module 508, a timer 510, an energy metering module 511, a power module 512, a storage repository 530, a hardware processor 520, a memory 522, a transceiver 524, an application interface 526, and, optionally, a security module 528. The components shown in FIG. 5 are not exhaustive, and in some embodiments, one or more of the components shown in FIG. 5 may not be included in an example gas-fired device. Any component of the example gas-fired device 502 can be discrete or combined with one or more other components of the gas-fired device 502.

A user 550 can be any person that interacts with gas-fired devices or components thereof (e.g., an ignition control system). Examples of a user 550 may include, but are not limited to, an engineer, an electrician, an instrumentation and controls technician, a mechanic, an operator, an emissions compliance officer, a regulatory agency, a consultant, a utility, a foreman, a contractor, and a manufacturer's representative. The user 550 can use a user system (not shown), which may include a display (e.g., a GUI). The user 550 interacts with (e.g., sends data to, receives data from) the controller 504 of the gas-fired device 502 via the application interface 526 (described below). The user 550 can also interact with the energy source 595 and/or one or more other components (e.g., a sensor module 560, the pressure-regulating device 579) of the gas-fired device 502. In some embodiments, the user 550 is optional.

Interaction between the user 550, the gas-fired device 502, and the energy source 595 can be conducted using communication links 505. Each communication link 505 can include wired (e.g., Class 1 electrical cables, Class 2 electrical cables, electrical connectors, power line carrier, DALI, RS485) and/or wireless (e.g., Wi-Fi, visible light communication, cellular networking, Bluetooth, WirelessHART, ISA100) technology. For example, a communication link 505 can be (or include) one or more electrical conductors that are coupled to the controller 504 of the gas-fired device 502 and to a sensor module 560. The communication link 505 can transmit signals (e.g., communication signals, control signals, data) between and/or within the gas-fired device 502, the user 550, and the energy source 595.

The one or more energy sources 595 of the system 500 provide one or more forms of energy to the gas-fired device 502. Examples of types of energy that can be provided by an energy source 595 can include, but are not limited to, electricity, fuel (in this case, a form of gas), and compressed air. When the energy delivered by an energy source 595 is electricity, one or more energy transfer links 596 can be used. An energy transfer link 596 can include one or more electrical conductors, sometimes bundled into one or more electrical cables, having characteristics (e.g., size, amperage rating) sufficient to provide the amount (e.g., 240V, 120V, 24V) and type (e.g., alternating current, direct current) of power required by the gas-fired device 502.

In such a case, the energy source 595 can include one or more of a number of components. Examples of such components can include, but are not limited to, an electrical conductor, a coupling feature (e.g., an electrical connector), a transformer, an inductor, a resistor, a capacitor, a diode, a transistor, and a fuse. The energy source 595 can be, or include, for example, a wall outlet, an energy storage device (e.g. a battery, a supercapacitor), a circuit breaker, and/or an independent source of generation (e.g., a photovoltaic solar generation system). The energy source 595 can also include one or more components (e.g., a switch, a relay, a controller) that allow the energy source 595 to communicate with and/or follow instructions from the user 550 and/or the controller 504.

When an energy source 595 delivers fuel to the gas-fired device 502, the energy source 595 can deliver the fuel using one or more delivery components 575. Examples of such delivery components 575 can include, but are not limited to, piping, a valve, and electrical wiring. An energy source 595 can be a utility (e.g., an electric utility, a natural gas utility), a retail energy marketer, a storage tank, or any other similar entity or component that can store and/or deliver a fuel to the gas-fired device 502.

The one or more sensor modules 560 can be any type of sensing device that measure one or more parameters. Examples of types of sensor modules 560 can include, but are not limited to, a passive infrared sensor, a photocell, a pressure sensor, a pressure monitor, a gas flow monitor, a fuel detector, a flame detector, and a resistance temperature detector. A parameter that can be measured by a sensor module 560 can include, but is not limited to, motion, strength and/or consistency of a flame from the burner 542, pressure within the air box 544, pressure within the air-moving device 536, temperature within the housing 503 of the gas-fired device 502, humidity within the housing 503 of the gas-fired device 502, pressure, air flow, gas/air mixture, and temperature (e.g., temperature within the burner 542, an ambient temperature).

In some cases, the parameter or parameters measured by a sensor module 560 can be used to operate the burner 542, the air-moving device 536, the gas valve 539, and/or the pressure-regulating device 579 of the gas-fired device 502. Each sensor module 560 can use one or more of a number of communication protocols. A sensor module 560 can be located within the housing 503 of the gas-fired device 502, disposed on the housing 503 of the gas-fired device 502, or located outside the housing 503 of the gas-fired device 502.

In certain example embodiments, a sensor module 560 can include an energy storage device (e.g., a battery) that is used to provide power, at least in part, to some or all of the sensor module 560. The energy storage device of the sensor module 560 can operate at all times or when a primary source of power to the gas-fired device 502 is interrupted. Further, a sensor module 560 can utilize or include one or more components (e.g., memory 522, storage repository 530, transceiver 524) found in the controller 504. In such a case, the controller 504 can provide the functionality of these components used by the sensor module 560. Alternatively, the sensor module 560 can include, either on its own or in shared responsibility with the controller 504, one or more of the components of the controller 504. In such a case, the sensor module 560 can correspond to a computer system as described below with regard to FIG. 6.

The burner 542 of the gas-fired device 502 is a device that burns a gas-air mixture received from the air-moving device 536 to generate heat. The burner 542 can have any of a number of configurations using any one or more of a number of components. In some cases, the burner 542 and the air box 544 are part of the same device or component.

The user 550 and the energy source 595 can interact with the controller 504 of the gas-fired device 502 using the application interface 526 in accordance with one or more example embodiments. Specifically, the application interface 526 of the controller 504 receives data (e.g., information, communications, instructions, updates to firmware) from and sends data (e.g., information, communications, instructions) to the user 550 and the energy source 595. The user 550 and/or the energy source 595 can include an interface to receive data from and send data to the controller 504 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof.

The controller 504 and/or the energy source 595 can use their own system or share a system in certain example embodiments. Such a system can be, or contain a form of, an Internet-based or an intranet-based computer system that is capable of communicating with various software. A computer system includes any type of computing device and/or communication device, including but not limited to the controller 504. Examples of such a system can include, but are not limited to, a desktop computer with a Local Area Network (LAN), a Wide Area Network (WAN), Internet or intranet access, a laptop computer with LAN, WAN, Internet or intranet access, a smart phone, a server, a server farm, an android device (or equivalent), a tablet, smartphones, and a personal digital assistant (PDA). Such a system can correspond to a computer system as described below with regard to FIG. 6.

Further, as discussed above, such a system can have corresponding software (e.g., user software, sensor software, controller software, network manager software). The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, LAN, WAN, or other network communication methods) and/or communication channels, with wire and/or wireless segments according to some example embodiments. The software of one system can be a part of, or operate separately but in conjunction with, the software of another system within the system 500.

The gas-fired device 502 can include a housing 503. The housing 503 can include at least one wall that forms a cavity 501. In some cases, the housing can be designed to comply with any applicable standards so that the gas-fired device 502 can be located in a particular environment (e.g., a hazardous environment) and/or sustain certain operating conditions (e.g., temperature, pressure).

The housing 503 of the gas-fired device 502 can be used to house one or more components of the gas-fired device 502, including one or more components of the controller 504. For example, as shown in FIG. 5, the controller 504 (which in this case includes the control engine 506, the communication module 508, the timer 510, the energy metering module 511, the power module 512, the storage repository 530, the hardware processor 520, the memory 522, the transceiver 524, the application interface 526, and the optional security module 528), the power supply 540, the sensor modules 560, the air-moving device 536, the gas valve 539, the pressure-regulating device 579, and the burner 542 are disposed in the cavity 501 formed by the housing 503. In alternative embodiments, any one or more of these or other components of the gas-fired device 502 can be disposed on the housing 503 and/or remotely from the housing 503.

The storage repository 530 can be a persistent storage device (or set of devices) that stores software and data used to assist the controller 504 in communicating with the user 550 and the energy source 595 within the system 500. In one or more example embodiments, the storage repository 530 stores one or more protocols 532, algorithms 533, and stored data 534. The protocols 532 can be any procedures (e.g., a series of method steps), logic steps, and/or other similar operational procedures that the control engine 506 of the controller 504 follows based on certain conditions at a point in time.

A protocol 532 can be used for communication purposes. In such a case, a protocol 532 can be any of a number of protocols that are used to send and/or receive data between the controller 504, the user 550, and the energy source 595. One or more of the protocols 532 can be a time-synchronized protocol. Examples of such time-synchronized protocols can include, but are not limited to, a highway addressable remote transducer (HART) protocol, a wirelessHART protocol, and an International Society of Automation (ISA) 100 protocol. In this way, one or more of the protocols 532 can provide a layer of security to the data transferred within the system 500. Other protocols 532 can be associated with the use of Wi-Fi, Zigbee, visible light communication, cellular networking, Bluetooth low energy (BLE), and Bluetooth.

The algorithms 533 can be any formulas, mathematical models, forecasts, simulations, and/or other similar models that the control engine 506 of the controller 504 uses to evaluate data (e.g., measurements made by a sensor device 560). One or more algorithms 533 can be used in conjunction with one or more protocols 532. For example, a protocol 532 can set forth that the control engine 506 direct a sensor device 560 to measure a parameter, store the measurements (as stored data 534 in the storage repository 530), and evaluate the measurements. As a specific example, the control engine 506 can follow a protocol 532 by instructing a flame-measuring device (a type of sensor device 560) to measure a flame of the burner 542 during an ignition phase of operation, and subsequently receive the measurements to determine (e.g., using one or more algorithms 533) when the ignition phase of operation is complete, as indicated by the measurements as to when the flame is stable.

Protocols 532 can be focused on certain components of the gas-fired device 502. For example, one or more protocols 532 can facilitate communication between a sensor module 560 and the control engine 506 of the controller 504. As a specific example, one or more protocols 532 can be used by the control engine 506 to instruct a sensor module 560 to measure a parameter (e.g., emissions), for the sensor module 560 to send the measurement to the control engine 506, for the control engine 506 to analyze (using one or more algorithms 533) the measurement (stored as stored data 534), and for the control engine 506 to take an action (e.g., instruct, using a different protocol 532, one or more other components (e.g., the pressure-regulating device 579) of the gas-fired device 502 to operate) based on the result (stored as stored data 534) of the analysis.

Stored data 534 can be any data associated with the gas-fired device 502 (including any components thereof), any measurements taken by the sensor modules 560, measurements taken by the energy metering module 511, threshold values, results of previously run or calculated algorithms, and/or any other suitable data. Such data can be any type of data, including but not limited to historical data, current data, and forecasts. The stored data 534 can be associated with some measurement of time derived, for example, from the timer 510.

Examples of a storage repository 530 can include, but are not limited to, a database (or a number of databases), a file system, a hard drive, flash memory, some other form of solid state data storage, or any suitable combination thereof. The storage repository 530 can be located on multiple physical machines, each storing all or a portion of the protocols 532, the algorithms 533, and/or the stored data 534 according to some example embodiments. Each storage unit or device can be physically located in the same or in a different geographic location.

The storage repository 530 can be operatively connected (coupled) to the control engine 506. In one or more example embodiments, the control engine 506 includes functionality to communicate with the user 550 and the energy source 595 in the system 500. More specifically, the control engine 506 sends information to and/or receives information from the storage repository 530 in order to communicate with the user 550 and the energy source 595. As discussed below, the storage repository 530 can also be operatively connected (coupled) to the communication module 508 in certain example embodiments.

In certain example embodiments, the control engine 506 of the controller 504 controls the operation of one or more components (e.g., the communication module 508, the timer 510, the transceiver 524) of the controller 504. For example, the control engine 506 can activate the communication module 508 when the communication module 508 is in "sleep" mode and when the communication module 508 is needed to send data received from another component (e.g., a sensor module 560, the user 550) in the system 500.

As another example, the control engine 506 can acquire the current time using the timer 510. The timer 510 can enable the controller 504 to control the gas-fired device 502 even when the controller 504 has no communication with the user 550. As yet another example, the control engine 506 can direct a sensor module 560 to measure and send emission information of the gas-fired device 502 to the user 550.

The control engine 506 of the controller 504 can communicate, in some cases using the gas valve 539, with one or more of the sensor modules 560 and make determinations based on measurements made by the sensor modules 560. For example, the control engine 506 can use one or more algorithms 533 to facilitate communication with a sensor module 560. For example, the control engine 506 can use one or more algorithms 533 to instruct a sensor module 560 to measure a parameter (e.g., pressure in the air box 544, flame stability of the burner 542), for the sensor module 560 to send the measurement to the control engine 506, for the control engine 506 to analyze the measurement (stored as stored data 534), and for the control engine 506 to take an action (e.g., instruct, using a protocol 532, one or more other components of the gas-fired device 502 to operate) based on the result (stored as stored data 534) of the analysis.

As a specific example, at the start of an ignition phase of operation of a gas-fired device 502, the control engine 506 can operate a pressure-regulating device 579 until a flame in the burner 542 is established. Then, once the flame in the burner 542 is established and the gas-fired device 502 is under normal operations, the control engine 506 can operate the pressure-regulating device 579 to return to an idle position.

The control engine 506 can also use the gas valve 539 to send and/or receive communications. As a specific example, the control engine 506 can use one or more algorithms 533 to receive (using a protocol 532) a signal received by the gas valve 539, for the control engine 506 to analyze the signal, and for the control engine 506 to take an action (e.g., instruct one or more other components of the gas-fired device 502 to operate) based on the result of the analysis. As another specific example, the control engine 506 can use one or more algorithms 533 to determine that a communication to a device external to the gas-fired device 502 needs to be sent, and to send a communication signal (using a protocol 532 and saved as stored data 534) to the gas valve 539.

The control engine 506 can provide control, communication, and/or other similar signals to the user 550 and the energy source 595. Similarly, the control engine 506 can receive control, communication, and/or other similar signals from the user 550 and the energy source 595. The control engine 506 can control each sensor module 560 automatically (for example, based on one or more algorithms 533 stored in the storage repository 530) and/or based on control, communication, and/or other similar signals received from another device through a communication link 505. The control engine 506 may include a printed circuit board, upon which the hardware processor 520 and/or one or more discrete components of the controller 504 are positioned.

In certain example embodiments, the control engine 506 can include an interface that enables the control engine 506 to communicate with one or more components (e.g., power supply 540) of the gas-fired device 502. For example, if the power supply 540 of the gas-fired device 502 operates under IEC Standard 62386, then the power supply 540 can have a serial communication interface that will transfer data (e.g., stored data 534) measured by the sensor modules 560. In such a case, the control engine 506 can also include a serial interface to enable communication with the power supply 540 within the gas-fired device 502. Such an interface can operate in conjunction with, or independently of, the protocols 532 used to communicate between the controller 504, the user 550, and the energy source 595.

The control engine 506 (or other components of the controller 504) can also include one or more hardware components and/or software elements to perform its functions. Such components can include, but are not limited to, a universal asynchronous receiver/transmitter (UART), a serial peripheral interface (SPI), a direct-attached capacity (DAC) storage device, an analog-to-digital converter, an inter-integrated circuit ($I^2C$), and a pulse width modulator (PWM).

The communication module 508 of the controller 504 determines and implements the communication protocol (e.g., from the protocols 532 of the storage repository 530) that is used when the control engine 506 communicates with (e.g., sends signals to, receives signals from) the user 550 and the energy source 595. In some cases, the communication module 508 accesses the stored data 534 to determine which communication protocol is used to communicate with the sensor module 560 associated with the stored data 534. In addition, the communication module 508 can interpret the communication protocol of a communication received by the controller 504 so that the control engine 506 can interpret the communication.

The communication module 508 can send and receive data between the energy source 595, the users 550, and the controller 504. The communication module 508 can send and/or receive data in a given format that follows a particular protocol 532. The control engine 506 can interpret the data packet received from the communication module 508 using the protocol 532 information stored in the storage repository 530. The control engine 506 can also facilitate the data transfer between a user 550, the energy source 595, and the controller 504 by converting the data into a format understood by the communication module 508.

The communication module 508 can send data (e.g., protocols 532, algorithms 533, stored data 534, operational information, alarms) directly to and/or retrieve data directly from the storage repository 530. Alternatively, the control engine 506 can facilitate the transfer of data between the communication module 508 and the storage repository 530. The communication module 508 can also provide encryption to data that is sent by the controller 504 and decryption to data that is received by the controller 504. The communication module 508 can also provide one or more of a number of other services with respect to data sent from and received by the controller 504. Such services can include, but are not limited to, data packet routing information and procedures to follow in the event of data interruption.

The timer 510 of the controller 504 can track clock time, intervals of time, an amount of time, and/or any other measure of time. The timer 510 can also count the number of occurrences of an event, whether with or without respect to time. Alternatively, the control engine 506 can perform the counting function. The timer 510 is able to track multiple time measurements concurrently. The timer 510 can track time periods based on an instruction received from the control engine 506, based on an instruction received from the user 550, based on an instruction programmed in the software for the controller 504, based on some other condition or from some other component, or from any combination thereof.

The timer 510 can be configured to track time when there is no power delivered to the controller 504 (e.g., the power module 512 malfunctions) using, for example, a super capacitor or a battery backup. In such a case, when there is a resumption of power delivery to the controller 504, the timer 510 can communicate any aspect of time to the controller 504. In such a case, the timer 510 can include one or more of a number of components (e.g., a super capacitor, an integrated circuit) to perform these functions.

The energy metering module 511 of the controller 504 measures one or more components of power (e.g., current, voltage, resistance, VARs, watts) at one or more points within the gas-fired device 502. The energy metering module 511 can include any of a number of measuring devices and related devices, including but not limited to a voltmeter, an ammeter, a power meter, an ohmmeter, a current transformer, a potential transformer, and electrical wiring. The energy metering module 511 can measure a component of power continuously, periodically, based on the occurrence of an event, based on a command received from the control module 506, and/or based on some other factor. For purposes herein, the energy metering module 511 can be considered a type of sensor (e.g., sensor module 560). In this way, a component of power measured by the energy metering module 511 can be considered a parameter herein.

The power module 512 of the controller 504 provides power to one or more other components (e.g., timer 510, control engine 506) of the controller 504. The power module 512 can include one or more of a number of single or multiple discrete components (e.g., transistor, diode, resistor), and/or a microprocessor. The power module 512 may include a printed circuit board, upon which the microprocessor and/or one or more discrete components are positioned. In some cases, the power module 512 can include one or more components that allow the power module 512 to measure one or more elements of power (e.g., voltage, current) that is delivered to and/or sent from the power module 512. Alternatively, the controller 504 can include a power metering module (not shown) to measure one or more elements of power that flows into, out of, and/or within the controller 504. Such a power metering module can also be considered a type of sensor (e.g., sensor module 560) herein.

The power module 512 can include one or more components (e.g., a transformer, a diode bridge, an inverter, a converter) that receives power (for example, through an electrical cable or other energy transfer link 596) from the power supply 540 and/or an energy source 595, and generates power of a type (e.g., alternating current, direct current) and level (e.g., 12V, 24V, 120V) that can be used by the other components of the controller 504. The power module 512 can use a closed control loop to maintain a preconfigured voltage or current with a tight tolerance at the output. The power module 512 can also protect the rest of the electronics (e.g., hardware processor 520, transceiver 524) in the gas-fired device 502 from surges generated in the line. In addition, or in the alternative, the power module 512 can be a source of power in itself to provide signals to the other components of the controller 504. For example, the power module 512 can be a battery. As another example, the power module 512 can be a localized photovoltaic power system.

In certain example embodiments, the power module 512 of the controller 504 can also provide power and/or control signals, directly or indirectly, to one or more of the sensor modules 560. In such a case, the control engine 506 can direct the power generated by the power module 512 to the sensor modules 560 of the gas-fired device 502. In this way, power can be conserved by sending power to the sensor modules 560 of the gas-fired device 502 when those devices need power, as determined by the control engine 506.

The hardware processor 520 of the controller 504 executes software, algorithms, and firmware in accordance with one or more example embodiments. Specifically, the hardware processor 520 can execute software on the control engine 506 or any other portion of the controller 504, as well as software used by the user 550 and the energy source 595. The hardware processor 520 can be an integrated circuit, a central processing unit, a multi-core processing chip, SoC, a multi-chip module including multiple multi-core processing chips, or other hardware processor in one or more example embodiments. The hardware processor 520 is known by other names, including but not limited to a computer processor, a microprocessor, and a multi-core processor.

In one or more example embodiments, the hardware processor 520 executes software instructions stored in memory 522. The memory 522 includes one or more cache memories, main memory, and/or any other suitable type of memory. The memory 522 can include volatile and/or non-volatile memory. The memory 522 is discretely located within the controller 504 relative to the hardware processor 520 according to some example embodiments. In certain configurations, the memory 522 can be integrated with the hardware processor 520.

In certain example embodiments, the controller 504 does not include a hardware processor 520. In such a case, the controller 504 can include, as an example, one or more field programmable gate arrays (FPGA), one or more insulated-gate bipolar transistors (IGBTs), one or more integrated circuits (ICs). Using FPGAs, IGBTs, ICs, and/or other similar devices known in the art allows the controller 504 (or portions thereof) to be programmable and function according to certain logic rules and thresholds without the use of a hardware processor. Alternatively, FPGAs, IGBTs, ICs, and/or similar devices can be used in conjunction with one or more hardware processors 520.

The transceiver 524 of the controller 504 can send and/or receive control and/or communication signals. Specifically, the transceiver 524 can be used to transfer data between the controller 504, the user 550, and the energy source 595. The transceiver 524 can use wired and/or wireless technology. The transceiver 524 can be configured in such a way that the control and/or communication signals sent and/or received by the transceiver 524 can be received and/or sent by another transceiver that is part of the user 550 and/or the energy source 595. The transceiver 524 can use any of a number of signal types, including but not limited to radio signals.

When the transceiver 524 uses wireless technology, any type of wireless technology can be used by the transceiver 524 in sending and receiving signals. Such wireless technology can include, but is not limited to, Wi-Fi, Zigbee, visible light communication, cellular networking, Bluetooth low energy (BLE), and Bluetooth. The transceiver 524 can use one or more of any number of suitable communication protocols (e.g., ISA100, HART) when sending and/or receiving signals. Such communication protocols can be stored in the protocols 532 of the storage repository 530. Further, any transceiver information for the user 550 and/or the energy source 595 can be part of the stored data 534 (or similar areas) of the storage repository 530.

Optionally, in one or more example embodiments, the security module 528 secures interactions between the controller 504, the user 550, and the energy source 595. More specifically, the security module 528 authenticates communication from software based on security keys verifying the identity of the source of the communication. For example, user software may be associated with a security key enabling the software of the user 550 to interact with the controller 504 and/or the sensor modules 560. Further, the security module 528 can restrict receipt of information, requests for information, and/or access to information in some example embodiments.

The power supply 540 of the gas-fired device 502 provides power to the burners 542, the air-moving device 536, the gas valve 539, the pressure-regulating device 579, the air box 544 (if so equipped), and sensor modules 560 and/or the controller 504 (or components thereof). The functionality and components of the power supply 540 can be substantially the same as, or different than, those of the power module 512 of the controller 504. The power supply 540 can include one or more of a number of single or multiple discrete components (e.g., transistor, diode, resistor), and/or a microprocessor. The power supply 540 may include a printed circuit board, upon which the microprocessor and/or one or more discrete components are positioned, and/or a dimmer.

The power supply 540 can include one or more components (e.g., a transformer, a diode bridge, an inverter, a converter) that receives power (for example, through an electrical cable) from an energy source 595 and generates power of a type (e.g., alternating current, direct current) and level (e.g., 12V, 24V, 120V) that can be used by the burners 542, the air-moving device 536, the gas valve 539, the pressure-regulating device 579, and sensor modules 560 and/or the controller 504 (or components thereof). In addition, or in the alternative, the power supply 540 can be a source of power in itself. For example, the power supply 540 can be a battery, a localized photovoltaic power system, or some other source of independent power.

One or more of the components of the controller 504 can be part of, or shared with, another component of the gas-fired device 502. For example, the pressure-regulating device 579 can have its own timer. Alternatively, the timer 510 of the controller 504 can be used to perform one or more time-related functions (e.g., count to five seconds) for the pressure-regulating device 579.

Figure 6:
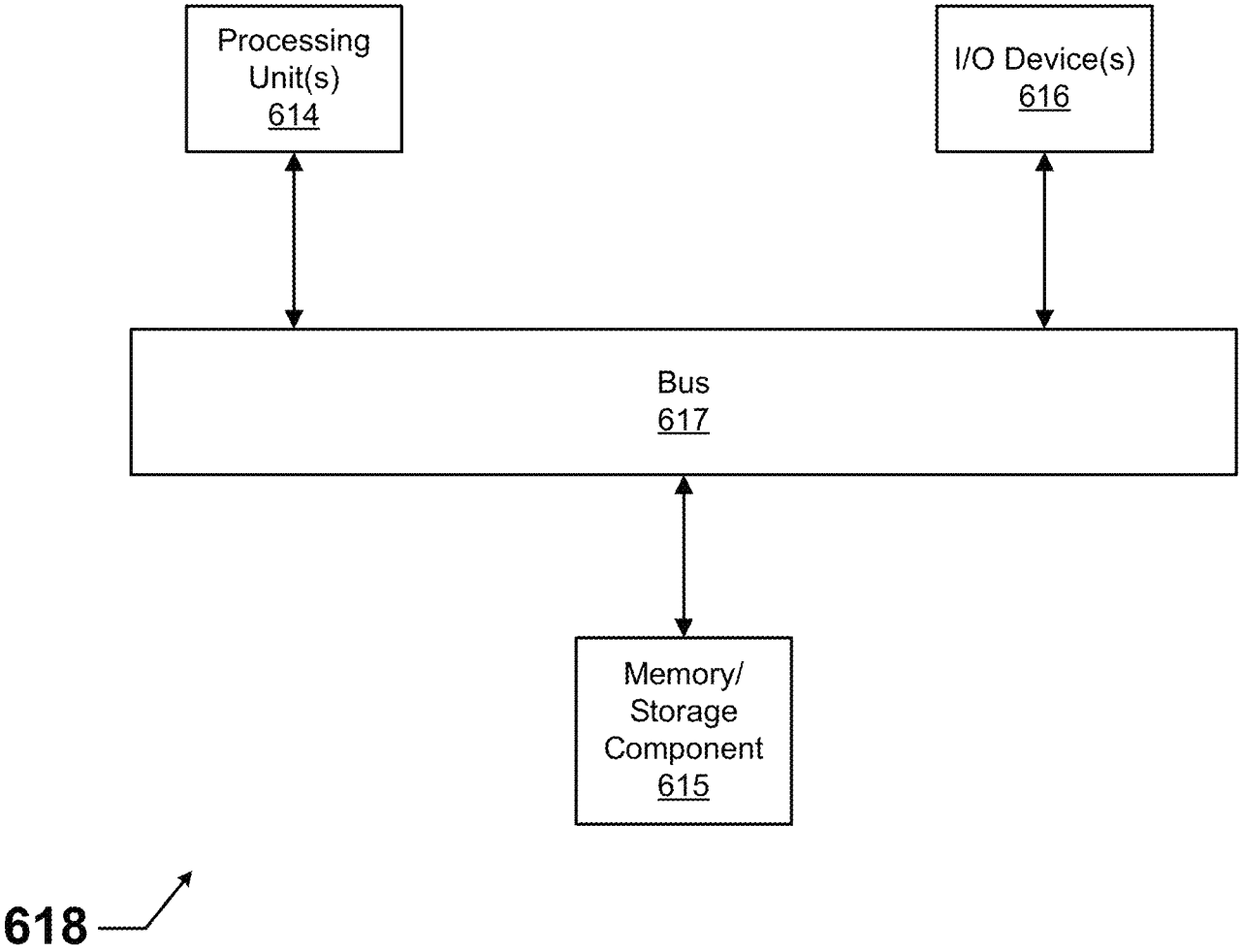
FIG. 6 shows a computing device in accordance with certain example embodiments.

FIG. 6 illustrates one embodiment of a computing device 618 that implements one or more of the various techniques described herein, and which is representative, in whole or in part, of the elements described herein pursuant to certain exemplary embodiments. Computing device 618 is one example of a computing device and is not intended to suggest any limitation as to scope of use or functionality of the computing device and/or its possible architectures. Neither should computing device 618 be interpreted as having any dependency or requirement relating to any one or combination of components illustrated in the example computing device 618.

Computing device 618 includes one or more processors or processing units 614, one or more memory/storage components 615, one or more input/output (I/O) devices 616, and a bus 617 that allows the various components and devices to communicate with one another. Bus 617 represents one or more of any of several types of bus structures, including a memory bus or memory controller, a peripheral bus, an accelerated graphics port, and a processor or local bus using any of a variety of bus architectures. Bus 617 includes wired and/or wireless buses.

Memory/storage component 615 represents one or more computer storage media. Memory/storage component 615 includes volatile media (such as random access memory (RAM)) and/or nonvolatile media (such as read only memory (ROM), flash memory, optical disks, magnetic disks, and so forth). Memory/storage component 615 includes fixed media (e.g., RAM, ROM, a fixed hard drive, etc.) as well as removable media (e.g., a Flash memory drive, a removable hard drive, an optical disk, and so forth).

One or more I/O devices 616 allow a customer, utility, or other user to enter commands and information to computing device 618, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 618 is connected to a network (not shown) (e.g., a local area network (LAN), a wide area network (WAN) such as the Internet, cloud, or any other similar type of network) via a network interface connection (not shown) according to some exemplary embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other exemplary embodiments. Generally speaking, the computer system 618 includes at least the minimal processing, input, and/or output means necessary to practice one or more embodiments.

Further, those skilled in the art will appreciate that one or more elements of the aforementioned computer device 618 is located at a remote location and connected to the other elements over a network in certain exemplary embodiments. Further, one or more embodiments is implemented on a distributed system having one or more nodes, where each portion of the implementation (e.g., control engine 106) is located on a different node within the distributed system. In one or more embodiments, the node corresponds to a computer system. Alternatively, the node corresponds to a processor with associated physical memory in some exemplary embodiments. The node alternatively corresponds to a processor with shared memory and/or resources in some exemplary embodiments.

Example embodiments can allow for more reliable and efficient operation of gas-fired devices, particularly when those gas-fired devices are in locations altitude, cold combustion air, and lean gas can affect ignitions. Example embodiments can be used when gas-fired devices are in start-up (ignition phase of operation) as opposed to normal operations. Example embodiments help to generate an enriched flame during the ignition phase of operation.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A fuel-fired device comprising:

an air-moving device that mixes air and a fuel to generate a fuel-air mixture;

an air box that provides the air to the air-moving device;

a vent valve;

a fuel valve that provides the fuel to the air-moving device based on a pressure of the air box, wherein the fuel valve comprises a tracking port coupled to the air box, wherein a pressure of the air box or a pressure of the vent valve is communicated to the tracking port;

a sensor configured to measure a characteristic of a flame at a burner;

a pressure-regulating valve disposed between, and in fluid communication with, the air box, the vent valve, and the tracking port of the fuel valve, wherein the pressure-regulating valve modifies, during an ignition phase of operation, the pressure communicated to the tracking port from the air box by creating a temporary artificial pressure; and a controller communicably coupled to the fuel valve, the sensor, and the pressure-regulating valve and configured to output a control signal to the pressure-regulating valve to instruct the pressure-regulating valve to enter an idle state when the controller determines a steady flame is present at the burner based on data received from the sensor.

2. The fuel-fired device of claim 1, wherein the pressure-regulating valve is in an idle state during normal operations.

3. The fuel-fired device of claim 1, wherein the pressure-regulating valve comprises a solenoid valve configured to modify the pressure of the air box communicated to the tracking port by creating the temporary artificial pressure.

4. The fuel-fired device of claim 3, wherein the solenoid valve creates the temporary artificial pressure by closing during the ignition phase of operation.

5. The fuel-fired device of claim 4, wherein the solenoid valve energizes to close during the ignition phase of operation.

6. The fuel-fired device of claim 4, wherein the solenoid valve de-energizes to close during the ignition phase of operation.

7. The fuel-fired device of claim 1, wherein the fuel is a gas.

8. The fuel-fired device of claim 1, wherein the pressure-regulating valve increases an amount of fuel provided by the fuel valve to the air-moving device.

9. The fuel-fired device of claim 1, wherein the controller operates the pressure-regulating valve during the ignition phase of operation.

10. The fuel-fired device of claim 1, further comprising:

a sensor module configured to measure the pressure of the air box at the tracking port and output pressure data to the controller.

11. A method for controlling ignition of a fuel-fired device, the method comprising:

receiving a first signal that an ignition phase of operation is beginning;

operating a pressure-regulating valve to modify a pressure of an air box communicated to a tracking port by creating a temporary artificial pressure during the ignition phase of operation, wherein the pressure-regulating valve is disposed between, and in fluid communication with, the air box, the tracking port, and a vent valve;

operating a fuel valve to provide a first flow of fuel to an air-moving device based on the temporary artificial pressure of the air box communicated to the tracking port;

determining that the ignition phase of operation is complete, based on data received from a sensor indicating a consistent flame at a burner;

operating the pressure-regulating valve to return to an idle state during normal operations after the ignition phase of operation is complete, so that the pressure-regulating valve stops to modify the pressure of the air box communicated to the tracking port; and operating the fuel valve to provide a second flow of fuel to the air-moving device based on an actual pressure of the air box communicated to the tracking port, wherein the actual pressure of the air box is not modified by the temporary artificial pressure created by the pressure-regulating valve.

12. The method of claim 11, wherein the first signal is received from a controller.

13. The fuel-fired device of claim 1, wherein the sensor is a flame detector configured to detect a temperature of the flame at the burner.

14. The method of claim 11, wherein the sensor is a flame detector configured to detect a temperature of the flame at the burner.

15. The fuel-fired device of claim 1, wherein the pressure-regulating valve is a three-way solenoid valve.

16. The method of claim 11, wherein the pressure-regulating valve is a three-way solenoid valve.

* * * * *